US009340398B2

(12) United States Patent
Ruth sen.

(10) Patent No.: US 9,340,398 B2
(45) Date of Patent: May 17, 2016

(54) SCISSOR LIFT TABLE

(71) Applicant: ROFA INDUSTRIAL AUTOMATION AG, Kolbermoor (DE)

(72) Inventor: Manfred Ruth sen., Straubing (DE)

(73) Assignee: ROFA INDUSTRIAL AUTOMATION AG, Kolbermoor (DE)

( * ) Notice: Subject to any disclaimer, the term of this patent is extended or adjusted under 35 U.S.C. 154(b) by 319 days.

(21) Appl. No.: 13/847,399

(22) Filed: Mar. 19, 2013

(65) Prior Publication Data

US 2013/0256611 A1 Oct. 3, 2013

(30) Foreign Application Priority Data

Mar. 27, 2012 (DE) ..... 10 2012 006 028

(51) Int. Cl.
*B66F 7/06* (2006.01)

(52) U.S. Cl.
CPC ..... *B66F 7/065* (2013.01)

(58) Field of Classification Search
CPC ..... B66F 7/065
USPC ..... 108/145; 254/122
See application file for complete search history.

(56) References Cited

U.S. PATENT DOCUMENTS

| | | | | | |
|---|---|---|---|---|---|
| 266,226 | A * | 10/1882 | Underhill et al. | ..... | 297/15 |
| 2,706,102 | A * | 4/1955 | Cresci | ..... | 254/8 C |
| 4,926,760 | A * | 5/1990 | Sack | ..... | 108/145 |
| 5,632,209 | A * | 5/1997 | Sakakibara | ..... | 108/145 |
| 7,059,616 | B2 * | 6/2006 | Wu | ..... | 280/47.24 |
| 7,213,686 | B2 | 5/2007 | Kaufman | | |
| 7,413,056 | B2 * | 8/2008 | Gonzi et al. | ..... | 187/269 |
| 2004/0251453 | A1 * | 12/2004 | Kaufman | ..... | 254/127 |
| 2006/0037518 | A1 * | 2/2006 | Lopez Alba | ..... | 108/145 |

FOREIGN PATENT DOCUMENTS

| | | | |
|---|---|---|---|
| DE | 1445200 | | 8/1938 |
| DE | 2635197 | A * | 2/1978 |
| DE | 197 16 760 | A1 | 10/1998 |
| DE | 20302374 | U1 * | 5/2003 |
| DE | 20316905 | U1 * | 4/2005 |
| DE | 10 2004 061182 | A1 | 6/2006 |
| DE | 10 2006 006 46 | A1 | 10/2006 |
| DE | 10 2006 006467 | A1 | 8/2007 |
| EP | 1375410 | A1 * | 1/2004 |
| EP | 1 454 873 | B1 | 11/2006 |

* cited by examiner

*Primary Examiner* — Lee D Wilson
*Assistant Examiner* — Joel Crandall
(74) *Attorney, Agent, or Firm* — Billion & Armitage; Benjamin C. Armitage

(57) ABSTRACT

The invention provides a scissor lift table having a base unit (12) and a carrier unit (14) being adjustable plane-parallel relative to the base unit (12) by means of a scissor unit(16) provided with a drive device (18).

7 Claims, 2 Drawing Sheets

SCISSOR LIFT TABLE

CROSS-REFERENCE TO RELATED APPLICATIONS

This application claims priority to German Application No. 10 2012 006 028.9, filed on 27 Mar. 2012, and which application is incorporated herein by reference. A claim of priority to all, to the extent appropriate, is made.

BACKGROUND

The present invention relates to a scissor lift table with the features of the subject matter of claim 1.

A scissor lift table of this kind is known, for example, from the publication EP 1 454 873 B1 and comprises a base unit, which can be provided, for example, with rollers or the like, and a carrier unit, which can be considered in the broadest sense to be a height-adjustable table top and which is adjustable plane-parallel relative to the base unit by means of a scissor unit provided with a drive device. The scissor unit comprises on both sides relative to the vertical longitudinal middle axis of the table a pair of scissor members with two scissor members, respectively, which are connected to each other by a joint and one of which is mounted with one end on a first pivot bearing, which is arranged stationary on the base unit, and with the other end it is movably guided on the carrier unit. The other scissor member is mounted with one end on a second pivot bearing, which is arranged stationary on the carrier unit, and with the other end it is movably guided on the base unit. For actuating the pairs of scissor members, that is for lifting and lowering the carrier unit relative to the base unit, its drive device has an elaborate lever structure which is engaged by a tensile means in the form of a cable, chain or belt.

SUMMARY

It is the object of the invention to create a scissor lift table of the above-mentioned kind having an optimized drive device with respect to the transmission of forces into the scissor unit.

This object is solved according to the invention by the scissor lift table with the features of claim 1.

According to the invention, a scissor lift table is provided which comprises a base unit and a carrier unit, said carrier unit being adjustable relative to the base unit by means of a scissor unit provided with a drive device. The scissor unit comprises at least one pair of scissor members with two scissor members, which are connected to each other by a joint and one of which is mounted with one end on a first pivot bearing arranged stationary on the base unit, and with the other end it is movably guided on the carrier unit. The other scissor member is mounted with one end on a second pivot bearing arranged stationary on the carrier unit, and with the other end it is movably guided on the base unit. The drive device comprises a toggle lever arrangement of which a first lever element engages one of the scissor members and a second lever element, which is connected to the first lever element and is pivotably mounted on the base unit, is provided with at least one windable tensile element.

By transmitting tensile forces into the second lever element, such lifting forces can be induced that the two scissor members are pivoted out relative to the base unit and the carrier unit is thus lifted relative to the base unit. Upon release of the tensile element, a lowering of the carrier unit takes place due to gravity because the scissor members are respectively pivoted back again in the direction of the base unit. By implementing an according design of the lever elements of the toggle lever arrangement, it becomes possible to lift and hold high loads with a relatively low expenditure of force.

In a preferred embodiment of the scissor lift table according to the invention, the tensile element is a drive belt, which can be unwound from a winding device or wound onto said winding device for actuating the carrier unit. The belts or bands could be manufactured from wear-resistant tissue or material so that the drive device of the scissor unit of the scissor lift table according to the invention can endure a plurality of actuating cycles.

For the optimization of the force induction into the toggle lever arrangement, the tensile element is preferably guided over at least one deflector element, in particular over at least one deflection roller. The deflection roller can be arranged on the base unit or also be a component of the toggle lever arrangement.

For further optimization of the force induction and for conserving the tensile element, it is advantageous if the second lever element, which is pivotably mounted on the base unit, has a curved guiding surface against which the windable tensile element comes to lie flat.

In a particular embodiment of the scissor lift table according to the invention, the second lever element has two shells, which are arranged laterally relative to a longitudinal middle plane of the table and which are connected to each other by a guiding device, which is in particular formed by a metal guiding sheet and which forms the curved guiding surface against which the at least one drive element comes to lie flat.

For ensuring a high operational safety, the scissor lift table according to the invention has at least two tensile elements, which are arranged parallel and engage the toggle lever arrangement and can be wound onto a shared winding device. The winding device is actuated in particular by an electric motor and is connected to a transmission of said motor.

The tensile element can be guided in particular over a deflector surface arranged on the second lever element towards a suspension device, which is fastened in the area of a joint axis between the first lever element and the second lever element of the toggle lever arrangement. Thereby, the forces acting on the suspension point of the tensile element can be reduced.

For increasing the lifting force of the scissor lift table according to the invention, a pulley-type transmission can be interposed between the drive motor and the at least one tensile element.

Further advantages and advantageous realizations of the subject matter of the invention can be taken from the specification, the drawing and the claims.

BRIEF DESCRIPTION OF THE DRAWINGS

An embodiment of the scissor lift table according to the invention is illustrated in the drawing in a schematically simplified manner and will be more closely explained in the following description.

DETAILED DESCRIPTION OF THE DRAWINGS

Figure 1:
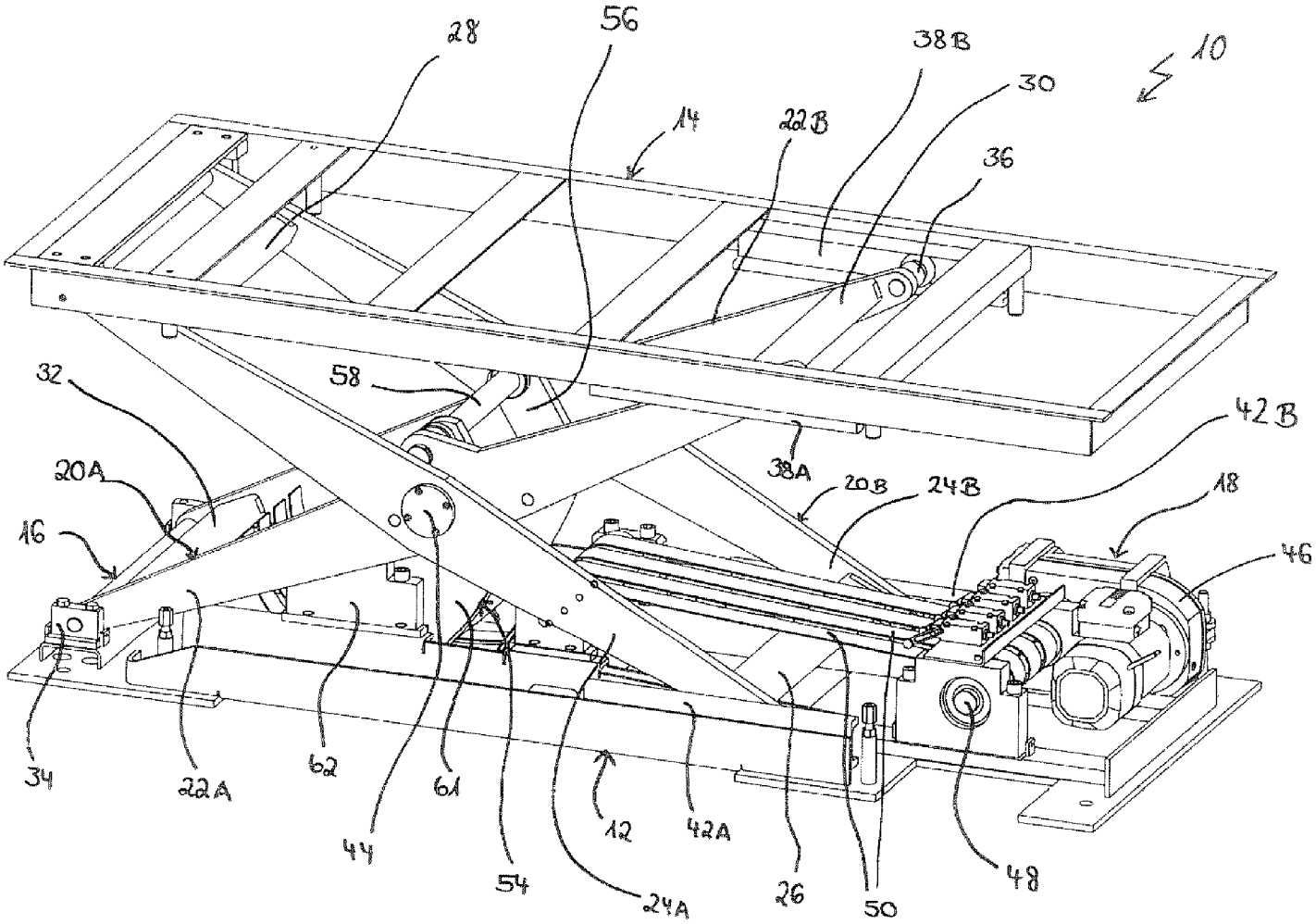
FIG. 1 shows a perspective view of a scissor lift table according to the invention.

In the drawing, a scissor lift table 10 is illustrated which serves, for example, for lifting and lowering high loads, for example, in the field of a production line of an automobile manufacturer and which can be arranged on a roller arrangement not illustrated here or also be mounted stationary.

The scissor lift table 10 comprises a base unit 12 and a carrier unit 14, which is arranged substantially plane-parallel to the base unit 12 and formed in the manner of a table top. The base unit 12 serves as a carrier for a scissor unit 16 and a drive unit 18 of the scissor unit 16.

The scissor unit 16 comprises on both sides relative to a vertical longitudinal middle plane of the scissor table one pair of scissor members 20A and 20B, respectively, which pair is respectively formed of a first scissor member 22A, resp. 22B, and a second scissor member 24A, resp. 24B, crossing the respective first scissor member. The scissor members 22A and 24A and the scissor members 22B and 24B are respectively connected by transverse struts 26, 28, resp. 30 and 32.

The first scissor members 22A and 22B are each pivotably mounted with one end on a pivot bearing 34, which is formed on the base unit 12. With the end facing away from the pivot bearing 34, the first scissor members 22A and 22B are each movably guided by a roll 36 in a guide rail 38A, resp. 38B, of the carrier unit 14.

The second scissor members 24A and 24B are each pivotably mounted with one end on a pivot bearing 39, which is arranged on the carrier unit 14 above the pivot bearing 34 of the base unit 12. With the end facing away from pivot bearing 39, the second scissor members 24A and 24B are each guided by a roll 40 in a guide rail 42A, resp 42B, formed on the base unit 12.

Further, the scissor members 22A and 24A and the scissor members 22B and 24B are respectively pivotably connected to one another by a joint 44.

For actuating the scissor mechanism made up of the two pairs of scissor members 20A and 20B, the scissor lift table 10 comprises a drive unit 18 which comprises a drive motor 46 which rotatably actuates a winding shaft 48 serving as a winding device. On the winding shaft 48, four drive belts or bands 50 are attached, which are oriented parallel towards one another and which can be unwound from or wound onto said winding shaft 48, depending on the sense of rotation. The drive belts 50 are guided starting from the winding shaft 48 over a deflection roller 52 formed as a cylinder towards a toggle lever arrangement 54.

The toggle lever arrangement 54 has a first lever element 56 on both sides relative to the vertical longitudinal middle plane of the scissor table, which lever element is connected to the corresponding scissor member 22A, resp. 22B, by an axis 58 and is connected on its end facing away from the axis 58 by a joint formed by a joint axis 60 to a second lever element 61, which is pivotably mounted on the base unit 12 by means of a joint 64 formed on a bearing block 62. The second lever element 61 is formed of two lateral lever shells 66, which are respectively pivotably mounted on the corresponding bearing block 62 by means of the joint 64 and are connected to each other by a metal guiding sheet 68 forming a guiding surface. Depending on the pivot position of the second lever element 61, the drive belts 50, which each constitute one tensile element, come to lie flat against the guiding sheet 68.

Further, the drive belts 50 are guided starting from the deflection roller 52 over the guiding sheet 68 and a rod 70 which is formed on the second lever element 61 on the end facing away from the joint axis 60, to a suspension device 72, which is suspended on the joint axis 60.

The actuation of the above-described scissor lift table 10 takes place in the manner described in the following.

Figure 2:
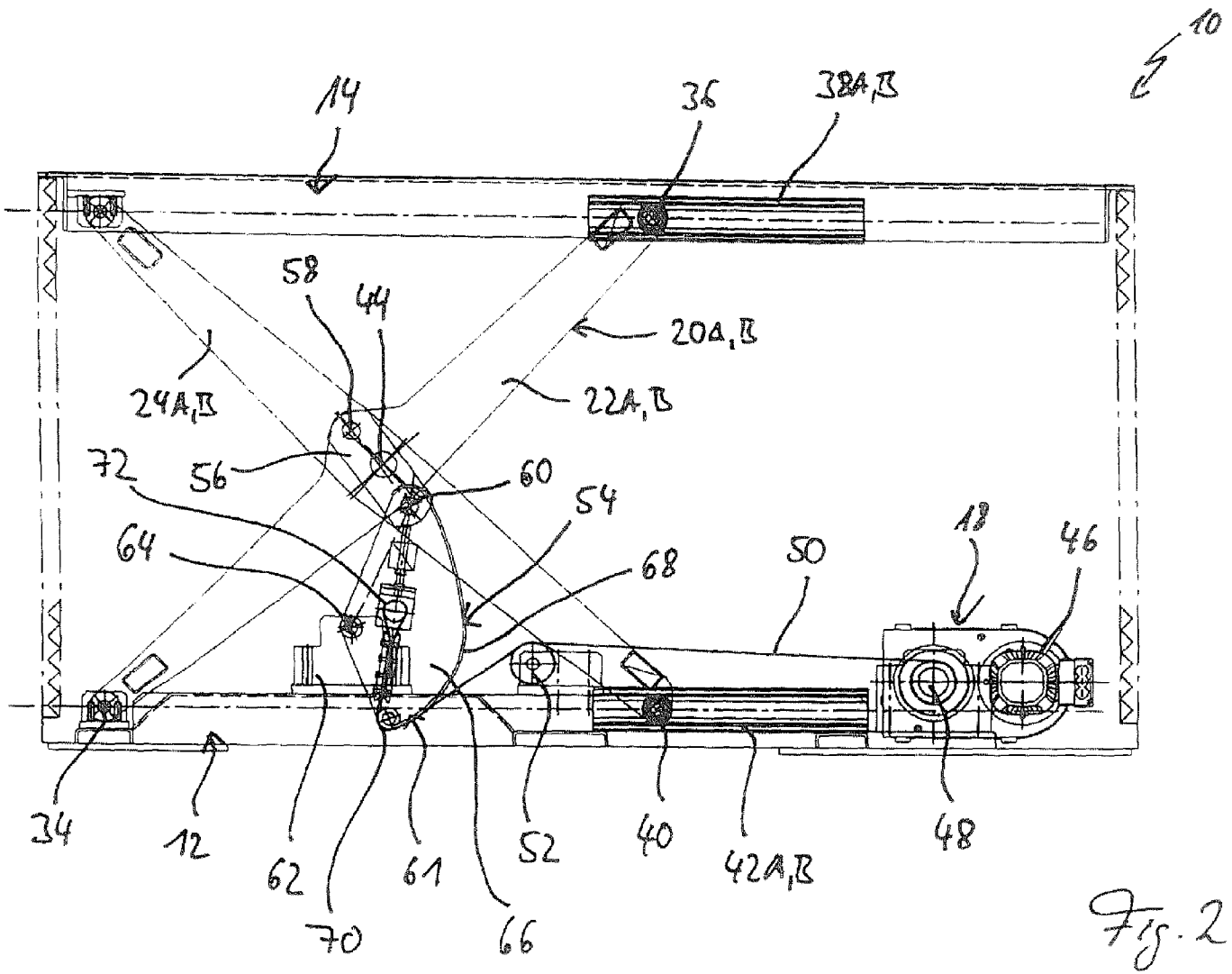
FIG. 2 shows a vertical longitudinal section through the scissor lift table.

Starting from a lowered position of the carrier unit 14, the drive motor 46 is actuated such that the winding shaft 48 according to FIG. 2 is rotated clockwise. In doing so, the drive belts 50 are wound onto the winding shaft 48 so that a tensile force is imparted to the second lever element 61 of the toggle lever arrangement 54 and said element effects an outward pivoting motion around the joint 64. This, in turn, causes an outward pivoting of the scissor members 22A, 22B, 24A and 24B via the first lever element 56 so that the carrier unit 14 is lifted relative to the base unit 12.

For lowering the carrier unit 14, the winding shaft 48 is rotated counter-clockwise so that the drive belts 50 are unwound from the winding shaft 48. Due to the load of the carrier unit 14 and of the pairs of scissor members 20A and 20B, the second lever element 61 is thus pivoted in, that is in the direction of the base unit 12, so that the carrier unit 14 is lowered due to gravity.

LIST OF REFERENCE SIGNS

| | |
|---|---|
| 10 | Scissor lift table |
| 12 | Base unit |
| 14 | Carrier unit |
| 16 | Scissor unit |
| 18 | Drive unit |
| 20A, 20B | Pair of scissor members |
| 22A, 22B | Scissor member |
| 24A, 24B | Scissor member |
| 26 | Transverse strut |
| 28 | Transverse strut |
| 30 | Transverse strut |
| 32 | Transverse strut |
| 34 | Pivot bearing |
| 36 | Roller |
| 38A, 38B | Guide rail |
| 39 | Pivot bearing |
| 40 | Roller |
| 42A, 42B | Guide rail |
| 44 | Joint |
| 46 | Drive motor |
| 48 | Winding shaft |
| 50 | Drive belt |
| 52 | Deflection roller |
| 54 | Toggle lever arrangement |
| 56 | First lever element |
| 58 | Axis |
| 60 | Joint axis |
| 61 | Second lever element |
| 62 | Bearing block |
| 64 | Joint |
| 66 | Lever shell |
| 68 | Guiding sheet |
| 70 | Rod |
| 72 | Suspension device |

The invention claimed is:

1. A scissor lift table comprising, a base unit and a carrier unit said carrier unit being adjustable relative to the base unit by means of a scissor unit provided with a drive device, wherein the scissor unit comprises at least one pair of scissor members having two scissor members which are connected to each other by a joint and one of which is mounted with one end on a first pivot bearing being arranged stationary on the base unit, and movably guided with the other end on the carrier unit, and the other scissor member is mounted with one end on a second pivot bearing being arranged stationary on the carrier unit and movably guided with its other end on the base unit, wherein the drive device comprises a toggle lever arrangement of which a first lever element engages one of the scissor members, and a second lever element, which is connected to said first lever element and pivotably mounted on the base unit, is provided with a windable tensile element, wherein the second lever element has a curved guiding surface against which the windable tensile element comes to lie flat.

2. The scissor lift table according to claim 1, wherein the tensile element is a drive belt, which, for actuating the carrier unit, can be unwound from a winding device or wound onto said winding device.

3. The scissor lift table according to claim 1, wherein the tensile element is guided over at least one deflector element, in particular at least one deflection roller.

4. The scissor lift table according to claim 1, wherein the tensile element is fastened to a suspension device of the second lever element, said suspension device being fastened in the area of a joint axis between the first lever element and the second lever element.

5. The scissor lift table according to claim 1, wherein the second lever element has two lever shells which are arranged laterally relative to a longitudinal middle plane of the table and are connected to each other via a guiding element which forms the guiding surface against which the at least one drive element comes to lie flat.

6. The scissor lift table according to claim 1, wherein at least two tensile elements which can be wound onto a shared winding device.

7. The scissor lift table according to claim 1, wherein a pulley-type transmission is interposed between a drive motor and the tensile element.

* * * * *